US005533709A

United States Patent [19]

Tarbell

[11] Patent Number: 5,533,709

[45] Date of Patent: Jul. 9, 1996

[54] WOODWORKING PRESS

[76] Inventor: Russell Tarbell, R.R.1, 84A, Hogansburg, N.Y. 13655

[21] Appl. No.: 526,043

[22] Filed: Sep. 8, 1995

[51] Int. Cl.[6] ..... B66F 3/08

[52] U.S. Cl. ..... 254/13

[58] Field of Search ..... 254/11–17, 100, 254/131, 133

[56] References Cited

U.S. PATENT DOCUMENTS

| | | | |
|---|---|---|---|
| 401,868 | 4/1889 | Townsend et al. . | |
| 754,115 | 3/1904 | Bailey . | |
| 785,491 | 3/1905 | Holcombe | 254/15 |
| 822,093 | 5/1906 | Wyer | 254/14 |
| 975,566 | 11/1910 | Norton | 254/16 |
| 1,094,449 | 4/1914 | Lauri . | |
| 1,310,637 | 7/1919 | Singleton . | |
| 2,258,022 | 10/1941 | McKee . | |
| 2,636,716 | 8/1949 | Fudge . | |
| 3,152,787 | 10/1964 | Timmons . | |

*Primary Examiner*—Robert C. Watson
*Attorney, Agent, or Firm*—Schmeiser, Olsen & Watts

[57] ABSTRACT

A woodworking press for effecting a mating of jointed boards. The instant invention is an elongated pressing/jacking device which includes, at one end, an anchor piece, at the other end a reversible head for contact of a workpiece and a central turnbuckle structure connecting the anchor and the head. The anchor is adapted for nailing to a substrate and has a feature to enhance prying the anchor from the substrate. The turnbuckle device is conventional, but is enhanced by use of a transfixed, shuttling handle. The head is unique in that it is designed having multiple edges which may be brought into mating contact with wood joint structures of varying morphology. Through use of a simple, yet elegant, connection mechanism, the head may be alternately positioned so as to present different mating configurations to the workpiece.

13 Claims, 1 Drawing Sheet

WOODWORKING PRESS

BACKGROUND OF THE INVENTION

1. Field of the Invention

This invention relates generally to tools defined as woodworking clamps, jacks and turnbuckles. In particular, it is directed toward new and useful improvements to a floor/sash jack or press which, when removably attached to a beam, joist or substrate, is useful for pressing and holding a workpiece in a desired position.

2. Discussion of the Relative Art

During a search of United States Patent Office records, a few pertinent disclosures were found which have a bearing on the instant invention. U.S. Pat. No. 1,094,449 relates to a floor clamping device that consists in a hand screw-secured, fined anchor which is joined by a threaded bolt to a turnbuckle coupler, which is in turn joined to a threaded bolt and then to a swivel mounted, plain rectangular head. The turnbuckle coupler is rotated by manipulation of a perpendicularly projecting handle that is placed in one of several holes girdling the turnbuckle coupler. The anchoring of the hand screw is more labor intensive than driving a nail; a rotation of a coupler requires up to several insertion and removal acts to press a floor board into position. Finally, the swivel head of the '449 device may be positioned in only one mode, shown to be the groove portion of a tongue-and-groove wood structure. Several difficulties in the usage of this device may be overcome with improvement to the anchor section, turnbuckle portion and the head. None are suggested by the patentee.

More appropriately described as a flooring jack is the tool disclosed in U.S. Pat. No. 401,868. This device consists in: a single screw jack having a threaded sleeve anchor member transfixed by external nail-receiving tabs; a selective rachet device for turning the screw by manipulation of a rachet handle; and a head, the workpiece-contacting edge of which is stylized or relieved to receive therein the tongue of a tongue-and-groove floor slat. The speed advantage a turnbuckle coupling, lost with reliance upon a single screw, is regained with the more manipulative rachet device of this tool. The nail-down tabs associated with its anchor provide a decided advantage over hand-screwed fasteners, but no ease of removal of the nails is provided. Relative to the tongue-receiving head, a great facility is provided in this tool; however, in view of the fact that a great deal of joint relief surfaces are of the shiplap relief, use of such a workpiece, or a reasonable mix with tongue-and-groove work pieces, would necessitate multiple head changes, thus requiring a greater inventory of parts. I have avoided such a dilemma by providing a new head design for my invention.

Although barely resembling the aforementioned tools, that disclosed in U.S. Pat. No. 951,557, and described as a press for floor boards, has relevance both in its title and in the fact that an alternate modality of use is provided. The basic tool profile in '557 is a scissor jack, thus the turnbuckle coupler mechanism is bifurcated; a centralized handle turns a single bolt that is threaded in one direction at a first end and in the opposite direction at the opposing, second end. A coupler part consisting in a threaded tube or block is situated on each end of the threaded bolt. Depending on the modality of use, one of the blocks may serve as an anchor and the other an anvil or headpiece. Although turned and anchored, the device does not use a member that is to be secured to the floor or substrate, but rather depends upon a clamping action or pressing action exerted between fixed members of the floor-wall construction. The '557 handle means, for turning the screw or threaded bolt, is adopted in the instant invention.

3. Incorporation by Reference

Because of their disclosure of certain fundamental aspects of woodworking presses or jacks, the following U.S. Pat. Nos. 401,868, 951,557, and 1,094,449 are hereinafter incorporated by reference.

SUMMARY OF THE INVENTION

A woodworking press or jack must be capable of urging a workpiece into a desired position for assembling, be adapted to the fastening or nailing process by offering as little interference to the impact mechanism, be easily secured and just as easily released, including the release of its anchoring mechanism, and be light weight and inexpensive to produce. The following described tool embodies the foregoing attributes and, in addition, features several unique features that do not appear in the art.

This invention is a tool for pressing jointed boards together and holding the juncture until securing devices such as nails or screws are inserted into the boards, thus permanently securing them in place. This tool includes, at one end, an aluminum extruded anchor with nail holes therein for securing the anchor to a joist, beam or substrate. The anchor also features a chamfered end which is positioned facing the substrate on which the anchor is secured. This allows insertion of a hammer claw or pinch bar between the anchor and the substrate in order to uproot it therefrom. The central body of the tool consists in a rapidly operable, high-mechanical advantage jacking or pressing mechanism; for this purpose I have chosen a turnbuckle. Essentially a turnbuckle is a coupling that is used between links of bolts, rods or wire, consisting of a metal loop with opposite internal threads at each end. The ends of the turnbuckle receive the bolts, rods or wire which are threaded for insertion into the turnbuckle. The turnbuckle may be used either for its clamping facility by drawing the bolt, rod or wire ends towards each other or for its pressing facility in that it can force the ends of the bolts, etc. away from each other. In either modality, the turnbuckle is an excellent choice for a mechanical driving device in that each turn of the central coupling effects a complete turn of the adjoining bolts, etc. Thus, in comparison to a standard, single-screw jack, the turnbuckle has a multiple speed and/or mechanical advantage. On the other side of the turnbuckle device, and the second end of the tool, is a reversible head for engaging the groove edges of whatever boards are to be pressed together. The generic "grooves" comprises, in preponderance, two types of lumber joints: shiplap; and tongue-and-groove.

Further defining my invention, the turnbuckle coupling is represented as a single tubular housing with ends internally threaded with reversible threads. The mating bolts are threaded and inserted in the turnbuckle body and their free ends are connected one to the anchor mechanism and the other removably fixed in the reversible head. Central of the turnbuckle body is a transferable and slidably mounted straight handle which is mechanically stopped at each end to preclude its complete removal from the body. The reversible head bears its own unique features: one side of the head, for engaging a workpiece, is horizontally grooved to mate with a shiplap joint feature; the opposite side is horizontally grooved to mate with a tongue-and-groove joint relief. The connection mechanism for removably joining the end of the head bolt to the reversible head consists in a through hole that is transfixed by a set screw. A few turns on the set screw will release the end of the bolt and the head may be immediately reversed to fulfill the user's instant need. Another feature of the head, although appearing in the prior art, has been improved for use with my unique contribution. Since it is the custom, in many cases of tongue-and-groove usage, to toenail the board, I have provided an arcuate chamfered surface central to the head edge that is designed to engage a tongue-and-groove joint feature. This chamfer is an impression, that is, it is concave inward toward the center of the head. Distinctive in the art, my impression passes clearly from top to bottom of the head. This would allow the woodworker (carpenter) to swing a hammer in an arcuate fashion go that the head of the hammer passes from the top of the head, arcuately through the head onto the substrate. This distinction, between my invention and the prior art, precludes the likelihood of the hammer head striking a bottom edge of the instant tool head.

DETAILED DESCRIPTION OF THE PREFERRED EMBODIMENT

Figure 1:
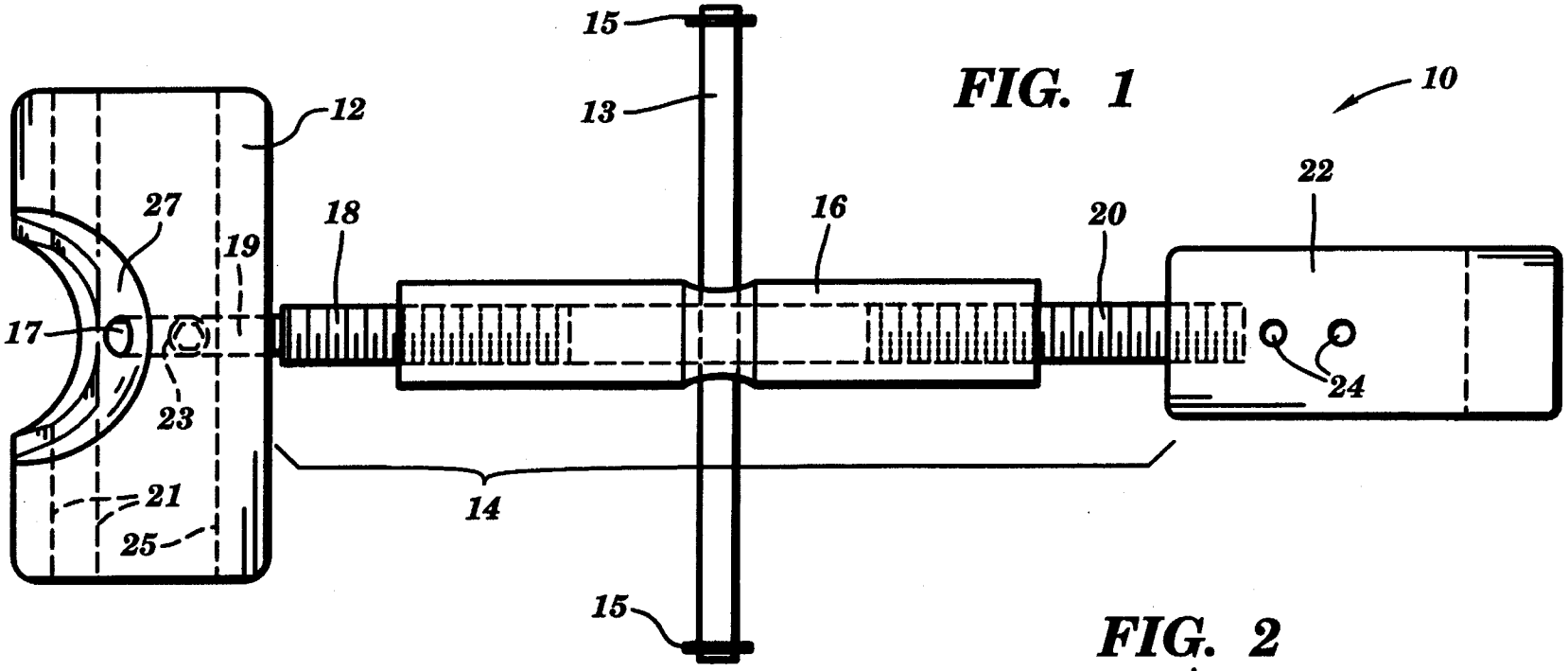
FIG. 1 is a plan illustration of the woodworking press.

Referring to the drawings, specifically FIG. 1, my woodworking press is designated generally the invention 10. The forward, working portion is further defined by the reversible head 12, a jack or pressing mechanism having turnbuckle 14 nature, which is further defined by a coupling 16 threadingly enclosing the ends of a head bolt 18 and an anchor bolt 20. A coupling 16 is axially rotatable by manipulation of the transfixing handle 13 which resides slidingly within the invisibly detailed passage central of the coupling 16. Removal of the handle 13 is impeded by C-clamp stops 15. As depicted in the prior art, the stops 15 may be any mechanical device having an impeding effect such as pins, knobs, etc. The anchor 22 is fixedly attached to the other end of threaded anchor bolt 20. From the plan view, holes 24 are seen centrally disposed in the anchor block. The invention 10 may be firmly anchored, by nail or screw, through these holes to a joist, beam or suitable substrate.

Still referring to FIG. 1, details of the forward portion of the invention 10 are seen with the reversible head 12 positioned so as to engage the joint relief features of a tongue-and-groove structure. Threaded head bolt 18 projects from out its location in the coupling 16, terminates in unthreaded portion 19 and is inserted into the head 12 through chamber 17. Once resident in the chamber 17, the unthreaded end 19 of head bolt 18 is removably fixed by tightening set screw 23. The edge morphology obtained through use of the reversible head 12 are designated in this plan view as tongue-and-groove relief 21 and lap relief 25. A most prominent feature of the invention in the FIG. 1 view is the crescent-shaped edge chamfer 27. The reader should note that this arcuate impression effects a bevel (chamfer) from the top surface of the head 12 through to the bottom, a portion of the bottom having a curvature similar to, but not identical with, the top surface arc. Were this edge of the head to engage a tongue-and-groove joint structure, the reader would view the tongue residing in the region defined by (invisible) lines 21. Also, the upper edge of the board serving as the workpiece would be clearly visible. If the board were to be toenailed, that is, a nail placed and driven on a slant, downward and toward the left at the board edge and tongue intersection, the woodworker's hammer head would have to traverse an arc which would sweep downward, missing the chamfered surface 27 and landing directly in front of the chamber 17 at the nail head. No part of the blow, however, would be directed toward the bottom edge of the head 12. This is assured by removing the bottom edge with carriage of the arcuate chamfer 27 completely through the bottom of the head.

Figure 2:
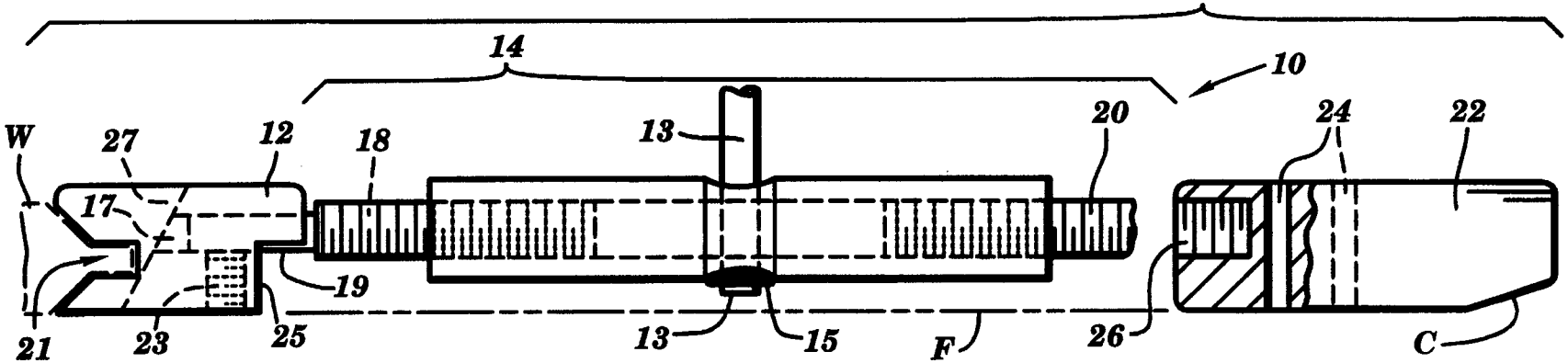
FIG. 2 is a side elevation, partially sectionalized view of the FIG. 1 device.

Having described the preponderance of detail to my invention, the reader's attention is called to FIG. 2, a partially sectionalized side elevation of the invention. In this view, the truly unique features of my invention may be more readily appreciated. The first, seen at the right hand side in the anchor 22, is the lower chamfered surface C of the anchor. The imaginary line F represents the floor, joist, or substrate on which the invention would be nominally set. One can see, therefore, that were nails to be used in holes 24 to secure the anchor 22, insertion of a hammer claw or pinch bar between the substrate F and the anchor chamfer surface C would allow easy unseating of the anchor. This is an important feature of the invention because ease of removal adds to the speed and efficiency of usage of this tool. Also, having a direct impact on the efficiency of use, is manipulation of handle 13 in the turnbuckle 14. Since the patent drawings which the reader is viewing show a device in approximately 90% actual size, the reader will appreciate the fact that when handle 13 is drawn so as to engage the coupling 16 with one of the stops 15, adequate clearance exists between the end of the handle 13 and the substrate F. This easy manipulation, coupled with the dual-acting coupling-bolt assembly, as well as the ready securement of the anchor 22, militates a highly efficient, yet simple, mechanism. At the left-hand side of FIG. 2, the head 12 is depicted coupled to bolt 18 and 19 and secured therewith by set screw 23. Recessed surface 25 corresponds to the relief feature of a standard shiplap joint structure. Relief 21, corresponding to a conventional tongue-and-groove joint structure is shown mated with such, designated as workpiece W. Release of set screw 23 allows withdrawal of bolt end 19 from the head which can be turned 180° so as to receive in the same chamber 17 the bolt end 19. Such action would, of course, present the shiplap relief 25 for engagement with such a workpiece.

Having detailed my invention, I would point out a few variations which should be readily apparent to those of ordinary skill. Firstly, the anchor 22 is large enough to sustain more than one beveled or chamfered edge. If the lateral bottom edges were also chamfered, even to lesser degree than shown on surface C, one could use a small pinch bar to create a "rocking" motion and free the anchor from a nail hold-down. The handle 13, rather than having stops 15, could terminate in screw-on, rounded heads or simply be terminated with screw-in, round head bolts that are of slightly larger diameter than the waist hole accomodating the handle 13. As to the reversible head 12, one can conceive of a square, rather than rectangular, shape. Were the need to arise, more than two edges could be supplied with stylized relief to fit other joint structures. It would be little problem to provide additional chambers 17 and set screws 23. Finally, various features of the prior art could be considered such as the racheting mechanism of U.S. Pat. No. 401,868. Such variations are commended, along with my invention as disclosed, to the field as a new and useful improvement in woodworking presses or jacks, consistent with the hereinafter appended claims.

What is claimed is:

1. A woodworking press comprising:

a first end including means for releasably attaching said press to a fixed element;

a linear translation mechanism connected to said first end; and a reversible head connected to said translation mechanism, said head including a first relieved surface for mating with a first wood joint structure and at least another relieved structure for mating with a second wood joint structure.

2. The press of claim 1 wherein said means for releasably attaching comprises, at said first end, at least one chamfered edge and at least one hole therethrough for receipt therein of a fixing device.

3. The press of claim 2 wherein said linear translation mechanism is a turnbuckle.

4. A woodworking press, comprising:

an anchor means for releasably attaching said press to a fixed element, said anchor means defining at least one chamfered edge;

an alternately collectable head including at least one relieved edge for mating said head to a wood joint structure, said head further including in at least one side thereof an arcuate chamfer disposed centrally in said side and from top through bottom of said head, and at least one connection device for permitting alternate head positional connection to a force generation mechanism; and a force generation mechanism connected intermediate and to said anchor means and said at least one connection device of said head, wherewith a force applied through said force generation mechanism to said anchor, when said anchor is attached to said fixed element, causes said head to translate with respect thereto.

5. The press of claim 4 wherein said anchor means comprises a block having means for fitting at least one attachment device therein.

6. The press of claim 4 wherein said force generation mechanism is a turnbuckle.

7. The press of claim 6 wherein said at least one connection device of said head is a chamber receptive therein of an end of a bolt connected to said turnbuckle.

8. The press of claim 7 wherein said at least one relieved edged for mating is a workpiece-contacting portion of the head that conforms to a shape of said workpiece.

9. A woodworking press comprising:

an anchor having means therein for releasably attaching the press to a substrate and including at least one chamfered edge to aid in prying said anchor from an attached position on the substrate;

a turnbuckle assembly comprised of a body from which project two opposing bolts, one of said bolts connected to the anchor and another of said bolts to a reversible head member so that the anchor and the reversible head member comprise ends of the jack; and the said reversible head member including at least two sides thereof that are each relieved to mate respectively with at least two different wood joint structures, said head member further including means for effecting a head-reversed connection to one of said turnbuckle assembly bolts.

10. The press of claim 9 wherein said means therein for releasably attaching comprises at least one hole for receipt therein of an attachment device.

11. The press of claim 9 wherein said at least two different wood joint structures are tongue-and-groove and shiplap shapes.

12. The press of claim 11 wherein means for effecting a head-reversed connection comprises at least one chamber receptive therein of an end of a turnbuckle assembly bolt, said at least one chamber disposed at a side opposite that presented to a workpiece.

13. The press of claim 9 wherein said reversible head further includes, in at least one side thereof, an arcuate impression effective for allowing an impact-delivering instrument to pass clearingly, from top through bottom, of said head.

* * * * *